United States Patent [19]

Troxell, Jr.

[11] 4,253,638

[45] Mar. 3, 1981

[54] BLOWOUT PREVENTER

[75] Inventor: John N. Troxell, Jr., Houston, Tex.

[73] Assignee: Cameron Iron Works, Inc., Houston, Tex.

[21] Appl. No.: 63,156

[22] Filed: Aug. 2, 1979

[51] Int. Cl.[3] ..... E21B 33/06

[52] U.S. Cl. ..... 251/1 A; 166/85; 166/92; 166/93; 277/127

[58] Field of Search ..... 251/1 R, 1 A, 1 B; 277/127; 166/85, 92, 93

[56] References Cited

U.S. PATENT DOCUMENTS

| | | | |
|---|---|---|---|
| 1,662,311 | 3/1928 | Hamer | 166/92 |
| 1,834,921 | 12/1931 | Abercrombie | 251/1 A |
| 1,899,922 | 3/1933 | Black | 251/1 R |
| 3,128,077 | 4/1964 | Lucky | 251/1 B |
| 3,208,357 | 9/1965 | Allen et al. | 251/1 A |
| 3,272,222 | 9/1966 | Allen | 251/1 A |
| 3,614,111 | 10/1971 | Regan | 251/1 B |
| 3,658,287 | 4/1972 | Le Rouax | 251/1 A |
| 3,897,040 | 7/1975 | Le Rouax | 251/1 B |

OTHER PUBLICATIONS

Shaffer Tool Works, p. 4564 et seq.–1962–1963 Composite Catalog of Oil Field Equipment & Services–Published by World Oil.

*Primary Examiner*—Martin P. Schwadron
*Assistant Examiner*—G. L. Walton
*Attorney, Agent, or Firm*—Vinson & Elkins

[57] ABSTRACT

A blowout preventer having a body and bonnets hinged thereto with throw latches for securing the bonnets to the body, wedges between the body and the hinges for adjusting the tilt of the bonnet and the position of the hinge side of the bonnets when closed and wedges between the body and the latches for adjusting the position of the latch side of the bonnets when closed.

4 Claims, 5 Drawing Figures

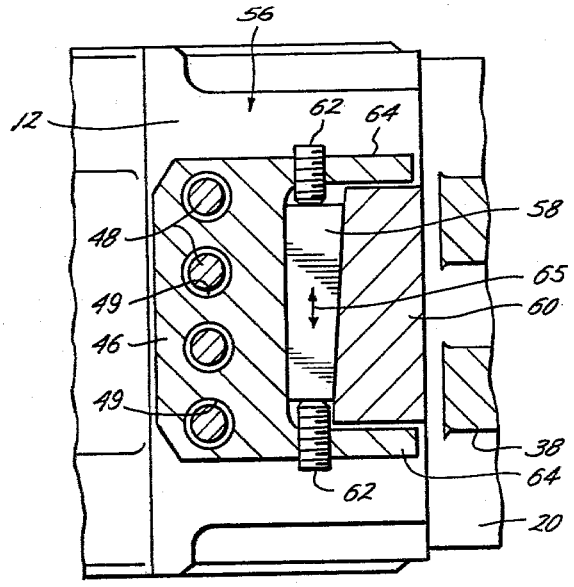
Fig. 2A
Fig. 3
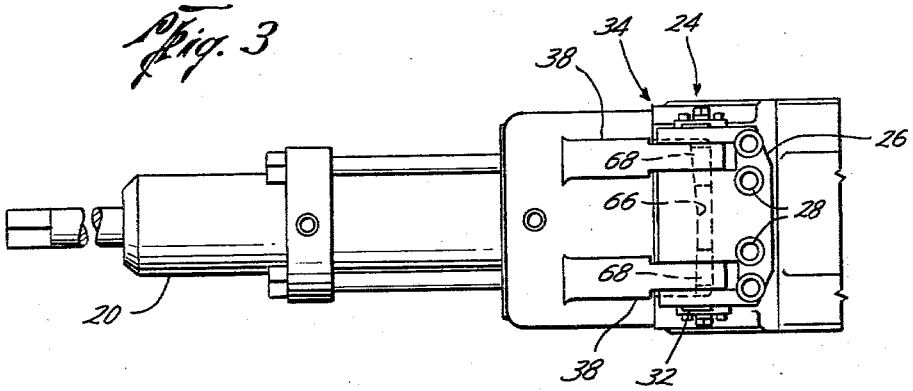
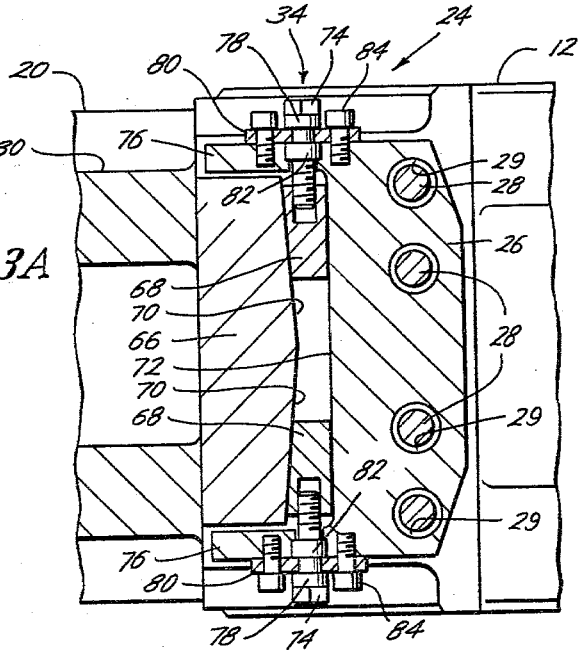
Fig. 3A

BLOWOUT PREVENTER

BACKGROUND

Blowout preventers often are opened in the field to change the rams if a different pipe size is to be used and also to inspect the rams. The bolts used to secure bonnets to the blow-out preventer body are generally large and require a high torque for seating the bonnet on the body. These factors make the removal and replacement of blowout preventer bonnets a difficult and time consuming operation.

It has long been a practice to pivotally mount the bonnet, such bonnets then being secured to the body by a ring of bolts (Shaffer Tool Works, page 4564 et seq. 1962-63 Composite Catalog of Oil Field Equipment and Services, published by World Oil). This structure assists in the movement of the bonnets once the high torque bolts have been disconnected but the removal and replacement of the blowout preventer bonnets is still a difficult and time consuming operation.

SUMMARY

The present invention relates to an improved blowout preventer in which the bonnets are pivotally mounted to the body and are secured thereto by a throw-type latch. The hinges and latches are made adjustable so that the bonnets seat and seal properly on the body in closed position regardless of deformation and wear.

An object of the present invention is to provide an improved blowout preventer with hinged bonnets so that the rams may be quickly and easily inspected and replaced.

Another object is to provide an improved blowout preventer having hinge mounted bonnets with adjustments available to compensate for wear in the hinges.

A further object is to provide an improved blowout preventer having hinged and latching bonnets with adjustments available to assure positive seating and sealing of the bonnets on the body in closed latched position.

BRIEF DESCRIPTION OF THE DRAWINGS

These and other objects and advantages are hereinafter set forth and explained with reference to the drawings wherein:

FIG. 2A is a detail sectional view of the latch and its adjustable mounting taken along line 2A—2A in FIG. 1.

FIG. 3 is an elevation view of the hinge taken along line 3—3 in FIG. 1.

FIG. 3A is a sectional view of the hinge adjustable mounting means taken along line 3A—3A in FIG. 1.

DESCRIPTION OF THE PREFERRED EMBODIMENT

Figure 1:
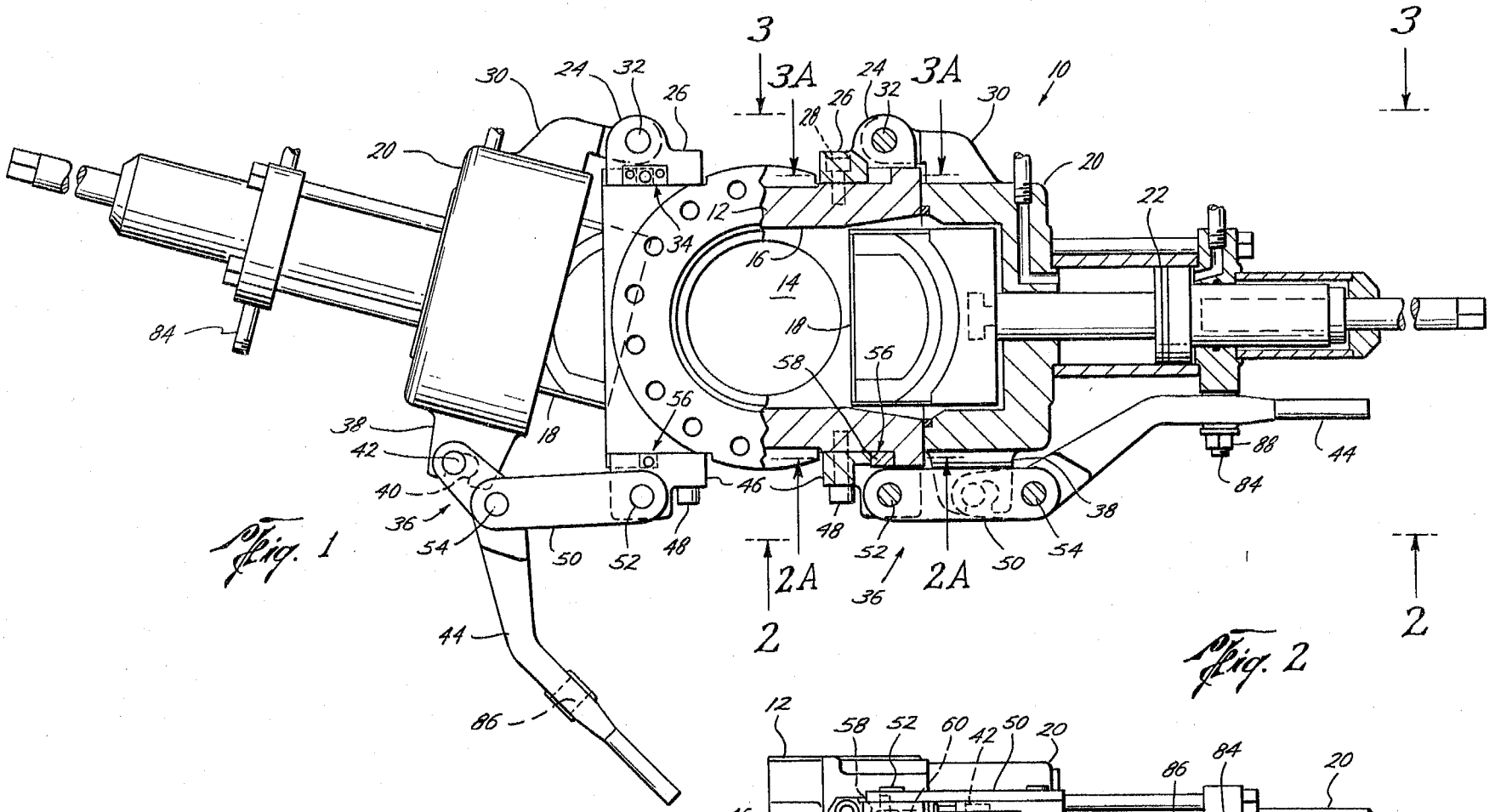
FIG. 1 is a plan view of the improved blowout preventer of the present invention with the right hand portion shown in section.

Blowout preventer 10 of the present invention includes body 12 having central bore 14 and guideways 16 intersecting bore 14, a ram assembly 18 positioned in each of the guideways 16, bonnets 20 pivotally secured to body 12 and ram actuating means 22 in bonnets 20.

Bonnets 20 are pivotally secured to body 12 by hinges 24 each of which includes leg 26 secured to body 12 by cap screws 28 which extend through oversized holes 29 in leg 26, leg 30 which is integral with bonnet 20 and pin 32 which is positioned in the bores in legs 26 and 30. Means 34 is provided for adjusting the position of bonnet 20 with respect to body 12 by tilting the axis of pins 32 and by moving hinge 24 either direction parallel to the axis of guideways 16 as hereinafter explained.

The other side of bonnets 20 are releasably connected to body 12 by throw latches 36. Each of latches 36 includes ear 38 secured to bonnet 20 and having slots 40 to receive pins 42 on the end of arm 44, latch block 46 which is secured to body 12 by screws 48 extending through oversized holes 49 in latch block 46 and links 50 which are pivotally connected to latch block 46 by pin 52 and pivotally connected to arm 44 by pin 54. Also associated with latch block 46 is means 56 for adjusting the closed position of the latch side of bonnet 20 to bring it into tighter or looser engagement with the face of body 12 as hereinafter explained.

Figure 2:
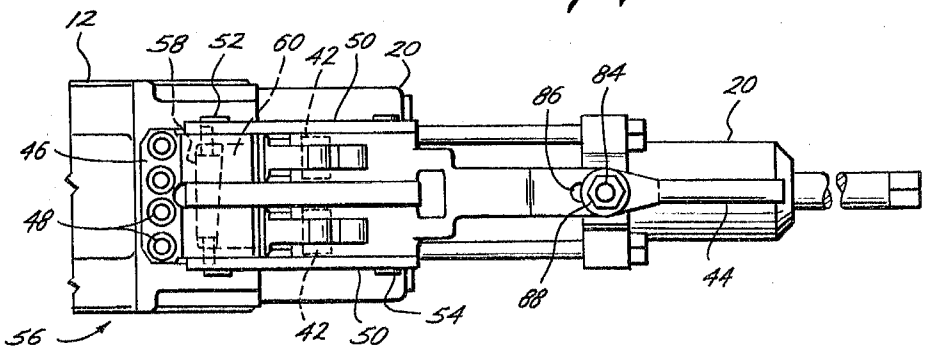
FIG. 2 is an elevation view of the latch taken along line 2—2 in FIG. 1.

Adjusting means 56 as shown in detail in FIG. 2A includes wedge 58 positioned between latch block 46 and tapered projection 60 which is an integral part of body 12. Wedge 58 is moved by screws 62 threaded through block legs 64 in the directions shown by the arrows 65. Because of the shape of projection 60 and wedge 58, as the wedge 58 moves toward the bottom of FIG. 2A, latch block 46 is moved away from bonnet 20 tightening the fit. Movement of wedge 58 in the opposite direction allows latch block 46 to move toward bonnet 20 loosening the fit. To make such adjustment, screws 48 are loosened and latch block 46 can move because of the oversize of holes 49. After adjustment by screws 62, screws 48 are agian tightened.

Hinge adjusting means 34 is shown in detail in FIGS. 3 and 3A and includes projections 66 on body 12 and wedges 68 which are movably positioned between tapered surfaces 70 on projection 66 and surface 72 on hinge leg 26. Wedges 68 are moved by screws 74 which are threaded into the ends of wedges 68, extend through legs 76 of hinge leg 26 and each has head 78 outside plate 80 and flange 82 inside plate 80 so that screws 74 are retained against axial movement. Thus, with screws 28 loosened and the oversize of holes 29 rotation of screws 74 causes sliding movement of wedges 68 to move hinge leg 26 away from projection 66 or allow it to be moved closer to projection 66. Plates 80 are secured to legs 76 as shown by cap screws 84.

The adjustments which can be provided by the movement of wedges 68 are tilting of the latch side of bonnet and inward and outward movement thereof. When wedges 68 are moved inwardly toward each other, bonnet 20 is moved to the right as viewed in FIG. 3A. When wedges 68 are moved outwardly or away from each other, bonnet 20 can be moved to the left. Movement of both wedges 68 in the upwardly direction in FIG. 3A allows bonnet 20 to be moved in a counterclockwise direction and movement of both wedges 68 downwardly allows bonnet 20 to be moved in a clockwise direction. All of these adjustments are accomplished by first loosening screws 28 and after bonnet 20 is adjusted, tightened to retain bonnet 20 in such position relative to body 12 when it is latched thereto.

Latch handle 44 moves against bonnet 20 as shown in the right hand portion of FIG. 1 with stud 84, which projects from bonnet 20, extending through hole 86 in handle 44 and nut 88 is threaded onto stud 84 to lock latch handle 44 in the bonnet closed position.

To adjust the tightness of the bonnet 20 fit to body 12, the screws 48 are first loosened. Thereafter screws 62 are adjusted to move wedge 58 upward to loosen the fit or downward to tighten the fit. With screws 28 loosened, screws 74 are rotated to move wedges 68 to the position providing the desired fit. To bring the top face of bonnet 20 toward body 12 (tighter fit) screw 74 is rotated to move upper wedge 68 downward. Similarly, to bring the lower face of bonnet 20 toward body 12 lower wedge 68 is moved upward. Movement of wedges 68 toward each other provides a tighter fit and their movement apart provides a looser fit. Screws 28 and 48 are tightened to retain hinges 24 and latches 36 in the adjusted position.

What is claimed is:

1. A blowout preventer comprising a body having a central bore and opposed guideways intersecting said bore, a ram assembly slidable in each of said guideways, a pair of bonnets, means for pivotally mounting each of said bonnets to said body whereby in one position said bonnet covers its guideway and in the other position said bonnet pivots away from the guideway to provide access to the interior of the bonnet and the guideway, a latch for securing each of said bonnets in position covering its guideway, means connecting said pivotal mounting means and said latches to said body, said connecting means being adjustable to assure that the mating faces of said bonnets and said body are parallel and a tight fit when said bonnet is closed.

2. A blowout preventer according to claim 1 wherein said latch connecting means are adjustable in a direction parallel to the axis of the guideways.

3. A blowout preventer according to claim 1 wherein said means connecting said pivotal mounting means to said body are adjustable about an axis transverse to the axis of said guideways.

4. A blowout preventer according to claims 1, 2 or 3 wherein said adjustable connecting means include wedges interposed between said body and said latches and between said body and said pivotal mounting means and coacting with tapered surfaces thereon, and means for moving said wedges to adjust the bonnets.

* * * * *